United States Patent [19]

Johnson et al.

[11] Patent Number: 4,610,350

[45] Date of Patent: Sep. 9, 1986

[54] PACKAGING FOR PAPER

[76] Inventors: Douglas R. Johnson, 2671 Jenkintown Rd., No. 2, Glenside, Pa. 19038; Nana Ribeiro, 415 Salisbury Rd., Wyncote, Pa. 19095

[21] Appl. No.: 758,548

[22] Filed: Jul. 24, 1985

[51] Int. Cl.[4] ..... B65D 77/02; B65D 85/62; B42F 3/00

[52] U.S. Cl. ..... 206/216; 206/215; 206/449; 206/45.33; 206/452; 402/4

[58] Field of Search ..... 206/216, 215, 45.33, 206/449, 451, 452, 494, 480, 482, 483, 586; 402/4, 24, 71

[56] References Cited

U.S. PATENT DOCUMENTS

| | | | |
|---|---|---|---|
| 530,806 | 12/1894 | Tilton | 402/24 |
| 1,817,488 | 8/1931 | Irving . | |
| 1,895,174 | 1/1933 | Shonts | 402/4 |
| 1,910,782 | 5/1933 | Way | 206/449 |
| 2,082,558 | 6/1937 | Unger | 402/24 |
| 2,114,944 | 4/1938 | Thomas | 129/1 |
| 2,131,699 | 9/1938 | O'Neill et al. | 206/45.33 |
| 2,495,687 | 1/1950 | Belmont | 206/1 |
| 2,593,152 | 4/1952 | Johnson et al. | 206/449 |
| 2,705,555 | 4/1955 | Brenner | 206/46 |
| 3,083,714 | 4/1963 | Foster | 129/23 |
| 3,147,694 | 9/1964 | Northup | 220/93 |
| 3,360,258 | 12/1967 | Nix | 206/449 |
| 3,727,823 | 4/1973 | Sullivan | 229/16 R |
| 4,157,875 | 6/1979 | Smith et al. | 402/4 |

FOREIGN PATENT DOCUMENTS

| | | | |
|---|---|---|---|
| 87294 | 5/1959 | Denmark | 206/459 |
| 1404623 | 9/1975 | United Kingdom | 206/586 |

OTHER PUBLICATIONS

"Perma Binder" ad, 2 pages, 3/15/1959.

*Primary Examiner*—William Price
*Assistant Examiner*—Brenda J. Ehrhardt
*Attorney, Agent, or Firm*—Dann, Dorfman, Herrell and Skillman

[57] ABSTRACT

Convertible packaging for a stack of leaved paper, such as fan-folded computer paper, provides a tray-shaped receptacle which may be converted to a binder for binding the paper after it has been printed on. The tray-shaped receptacle has detachable sidewalls and a bottom panel which are formed to be reassembled as a binder for computer printout and the like.

11 Claims, 4 Drawing Figures

FIG. 1
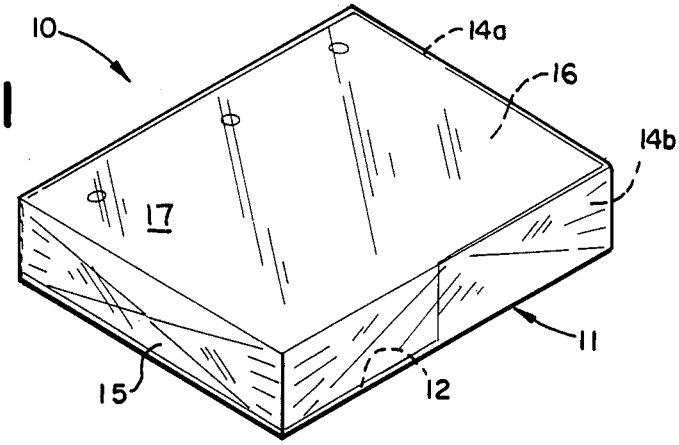
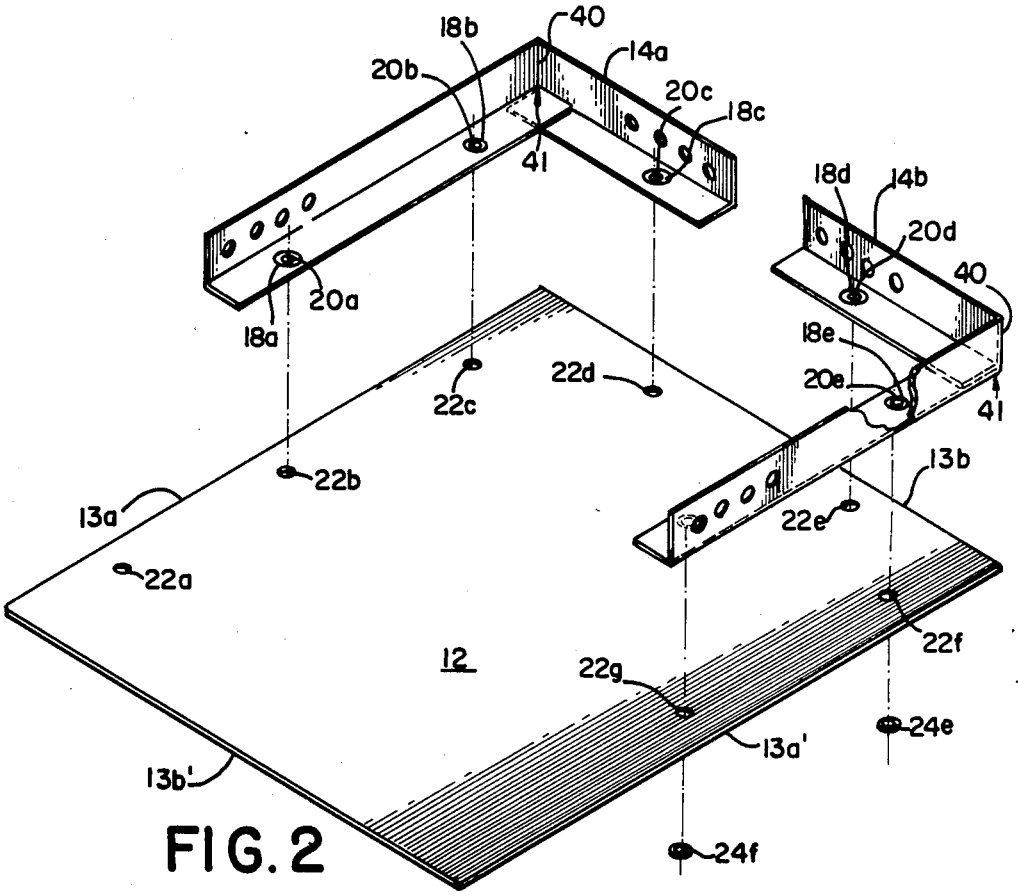
FIG. 2

PACKAGING FOR PAPER

BACKGROUND OF THE INVENTION

This invention relates generally to packaging of looseleaf or continuously folded sheets and more particularly to a packaging article adaptable for use as both a paper tray and a binder.

As the use of computers has grown, the generation of computer printout has grown exponentially. Accordingly, there is an ever increasing demand for computer paper, particularly the type that is fan folded for continuous feed.

Since computer paper is usually bought and used in bulk quantities, it is desirable that the packaging permit easy storage and handling. Furthermore, the paper itself should be easily handled and stored after it has been printed on.

Single purpose trays and other feeder devices are available for conveniently handling the computer paper prior to printing. Likewise, there are special purpose binders for binding computer printout. However, the use of such special purpose accessories increases the cost of material and handling of computer printout since these accessories must be bought and stocked separately from the paper itself.

SUMMARY OF THE INVENTION

Accordingly, it is an object of this invention to provide a package for paper which provides the convenience of both handling trays and printout binders without substantial cost increase. A paper tray/binder embodied in the packaging unit of the invention provides a sturdy tray which neatly holds a stack of paper for direct feed to a printer. The tray, which may include a cover panel, holds a convenient supply of paper, and the tray and paper are preferably enclosed in a wrapper to form a complete package for handling and storing the paper prior to use.

The tray structure is readily converted to use as a binder. To this end, the tray walls are detachable from the tray bottom and are adapted to be converted to binder hinges. These hinges may be repositioned and reattached to the tray bottom, and, if desired, also to the cover panel, after the paper has been used. Alternatively, the tray walls may be hingedly attached to the tray bottom but yet releasable. Selected tray walls may then be removed from the tray. In this manner, a binder is formed to receive and bind together the computer printout generated on the paper. The resulting binder permits easy handling and filing of the printout.

BRIEF DESCRIPTION OF THE DRAWINGS

The foregoing summary, as well as the following detailed description of a preferred embodiment of the present invention, will be better understood when read in conjunction with the appended drawings, in which:

FIG. 1 shows a complete package unit embodying the invention as it is sold or stored;

FIG. 2 is an exploded view of the components of the package unit of FIG. 1 assembled for use as a tray;

DESCRIPTION OF THE PREFERRED EMBODIMENT

Figure 3:
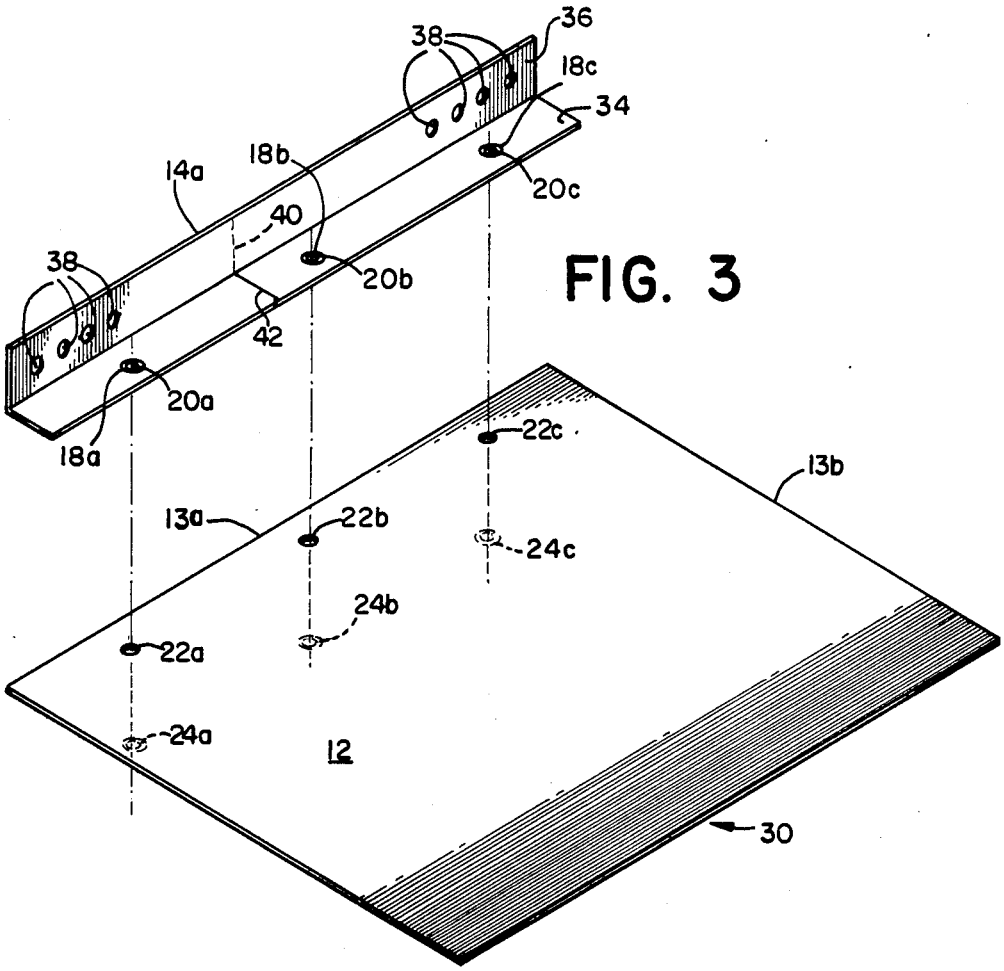
FIG. 3 is an exploded view of the components of the package unit of FIG. 1 assembled for use as a binder.

Referring now to the drawings wherein like reference numerals indicate identical or corresponding elements across the several views, and in particular to FIG. 1, there is shown generally a paper package 10 embodying the invention. The package 10 includes a tray-shaped receptacle 11 formed from a bottom panel 12 and a pair of sidewalls 14*a* and 14*b* releasably attached thereto so as to project out of the plane of the panel. A stack of leaved paper 15 is nested within tray-shaped receptacle 11, and in the illustrated embodiment the package includes a wrapper 17 such as cellophane or other wrapping material. A cover panel 16 is included as a top cover for the paper 15 prior to installing the wrapper 17 for additional protection. The panels 12 and 16 and the sidewalls 14*a* and 14*b* are made of card stock or other sheet material to provide a high degree of protection at a minimum cost. The package 10 forms a complete unit for handling and storage of the paper 15 prior to use.

Referring now to FIG. 2, the tray-shaped receptacle 11 is shown in greater detail. The tray-shaped receptacle 11 has a bottom panel 12, a pair of sidewalls 14*a* and 14*b*, and may have a cover panel 16 (not shown in this view for clarity) all made of a sturdy sheet material, such as card stock. Bottom panel 12 has opposite side edges 13*a*,13*a*' and like opposing end edges 13*b*,13*b*'. The sidewalls 14*a*,14*b* are disposed perpendicular to the plane of the panel 12 and have a length corresponding to the length of the side edges 13*a*,13*a*', but are transversely folded at score line 40 intermediate their ends to provide trihedral corners 41. The sidewalls 14*a*,14*b* are removably attached to the bottom panel 12 with their respective corners overlying corresponding adjacent corners on the bottom panel 12 to provide lateral positioning of the paper stacked on bottom panel 12.

When the paper 15 has been used up, sidewalls 14*a*,14b may be detached from bottom panel 12. Each is straightened or unfolded to form a binder hinge, as shown in FIG. 3. Sidewall/hinge 14*a*, which is typical, is then repositioned and attached along one edge, for example side edge 13*a*, of bottom panel 12 to form a binder 30. Sidewall/hinge 14*b* may be attached along a corresponding edge of cover panel 16 to form a second binder or matching binder end. The paper which has been printed on may be bound to one or between both of the binders 30 by means of conventional fasteners to form a sturdy, easy to file portfolio of the printout.

Figure 4:
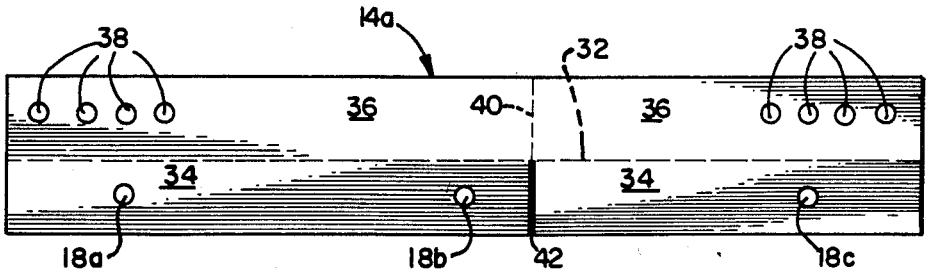
FIG. 4,shows a preferred embodiment of a sidewall-/hinge strip as utilized in FIGS. 2 and 3.

Referring now to FIG. 4, sidewall/hinge 14*a*, which is typical, is shown in greater detail. A longitudinal score line 32 or other hinge means extends substantially the length of sidewall/hinge 14*a*. Longitudinal score line 32 permits sidewall/hinge 14*a* to be folded into two sectors which may overlap one another: a panel attachment sector 34 and a paper attachment sector 36. Panel attachment sector 34 has means to attach the sector to one of the panels 12 or 16, in the present instance the assembly means includes a plurality of holes 18*a–c* formed in the sector 34 at preselected intervals. Holes 18*a–c* are spaced for alignment with corresponding holes 22*a–c* in bottom panel 12 as shown in FIGS. 2 and 3. Paper attachment sector 36 has means for binding the sector to a stack of leaves of paper 15, in the present instance the binding means includes a distinct set of holes 38 formed in it. Holes 38 are spaced for alignment with preformed holes in the paper. A transverse score line 40, which forms the corner 41, extends across paper attachment sector 36 and a transverse slit 42 aligned with the score line 40 across panel attachment sector 34 allow sidewall/hinge 14*a* to be folded into a trihedral corner having mutually perpendicular segments as shown in FIG. 2.

To complete the assembly of the panels with the sectors, removable fasteners 20, such as snap fasteners, are mounted in holes 18*a–c*, respectively, in sidewall-/hinge 14*a*. The male parts of the fasteners 20*a–c* are inserted through corresponding holes 22*b–d* disposed along side edge 13*a* and end edge 13*b* of bottom panel 12, and the female parts 24*a–c*, such as snap rings or sockets, engage with the male fasteners 20*a–c* such that sidewall/hinge 14*a* is removably attached to bottom panel 12. Likewise, removable male fastener parts 20*d–f* are mounted in holes 18*d–f* respectively in sidewall-/hinge 14*b*. Male fastener parts 20*d–f* are inserted through corresponding holes 22*e–g* disposed along end edge 13*b* and side edge 13*a'* of bottom panel 12. Retainers or female fastener parts 24*d–f* engage with male fastener parts 20*d–f* such that sidewall/hinge 14*b* is attached to bottom panel 12, thereby forming the tray-shaped receptacle 11.

When the paper 15 has been used, fasteners 20 may be released, thereby detaching sidewalls 14*a*,14*b* from bottom panel 12. Sidewall/hinge 14*a* is then unfolded and relocated or repositioned to be coextensive with the side edge 13*a*. The fasteners 20 are inserted through corresponding holes 22*a–c* disposed along side edge 13*a* of bottom panel 12 to form a binder element 30. Again, the female fastener parts 24*a–c* engage with the male fastener parts 20*a–c* to attach sidewall/hinge 14*a* to the bottom panel 12. Sidewall/hinge 14*b* may be similarly detached, unfolded, repositioned, and attached to a cover panel 16 to provide a second binder element.

Some of the many novel features and advantages of the present invention are now apparent in view of the foregoing description. For example, an inexpensive and easy-to-use article for packaging and storing a stack of leaved paper and the like has been described which has dual configurations. A tray-shaped receptacle 11 for the paper has detachable sidewalls 14*a* and 14*b*. The sidewalls may be removed and used in conjunction with the bottom panel 12 of the receptacle 11 to form a binder with which to bind the paper after it has been printed.

It will be recognized by those skilled in the art that changes or modifications may be made to the above-described embodiment without departing from the broad inventive concepts of the invention. It is understood, therefore, that the invention is not limited to the particular embodiment which is described, but is intended to cover all modifications and changes within the scope and spirit of the invention as defined in the appended claims.

What is claimed is:

1. A tray-shaped package for a stack of leaves of paper and the like which is adapted for conversion to a binder, comprising:

a panel of sheet material with mutually perpendicular end and side edges, said panel having its length and width substantially coextensive with one of said leaves of paper;

wall means of sheet material for laterally positioning the paper in registry with said panel;

attachment means for releasably attaching said wall means to said panel along its edges so that said wall means projects out of the plane of the panel;

said wall means having means for binding leaves of paper;

said wall means having a pair of transverse hinges and said attachment means securing said wall means with its transverse hinges overlying adjacent corners of said panel such that said wall means extends along adjacent edges of said panel to form a tray; and fastening means operable upon release of said attachment means for coupling said wall means to the panel in a different position along an edge thereof to expose said binding means whereby a binder is formed for said leaves from said panel and said wall means.

2. An article as recited in claim 1 wherein said wall means comprises an elongated strip having longitudinal hinge means extending substantially coextensive with the length of said strip for folding said strip into overlapping first and second sectors, said first sector being adapted for attachment to said panel and said second sector providing said means for binding said leaves of paper.

3. An article as recited in claim 1 further comprising:

a second panel of sheet material, said second panel having mutually perpendicular end and side edges and being substantially coextensive with said first panel; and second fastening means operable upon release of said attachment means for coupling said wall means to said second panel along an edge corresponding to that of said first panel, whereby a double-ended binder is formed for said leaves from said panels and said wall means.

4. An article as recited in claim 3 wherein said wall means comprises first and second strips each of said strips comprising:

longitudinal hinge means extending substantially the length of said strip for folding said strip into first and second sectors;

said first sector being adapted for attachment to one of said panels, and said second sector having said means for binding said leaves of paper.

5. A tray-shaped package for a stack of leaves of paper and the like which is adapted for conversion to a binder, comprising:

a panel of sheet material with mutually perpendicular end and side edges, said panel having its length and width between said edges substantially coextensive with one of said leaves of paper;

wall means of sheet material for laterally positioning the paper in registry with said panel;

attachment means for removably attaching said wall means to said panel along at least two of said edges such that said wall means projects out of the plane of the panel;

said wall means having means for binding leaves of paper thereto;

said wall means having a length corresponding to the length of one of said edges of said panel, a intermediate transverse hinge, said removable attachment means securing said wall means with its transverse hinge overlying a corner of said panel between adjacent edges thereof such that said wall means extends along adjacent edges of said panel to form a trihedral corner; and fastening means operable upon release of said attachment means for coupling said wall means to said panel coextensive with and along said one edge of the panel whereby a binder may be formed for said leaves from said panel and said wall means.

6. An article as recited in claim 5 wherein said wall means comprises:

longitudinal hinge means extending coextensively with the length of said wall means for folding said wall means into first and second sectors, said first sector having means for attachment to said panel and said second sector having means for binding said leaves of paper.

7. An article as recited in claim 6 further comprising:

a second panel of sheet material, said second panel being substantially coextensive with said first panel;

second wall means of like sheet material, said second wall means being adapted to be removably attached to said first panel along at least two of said edges of said first panel, for laterally positioning the paper in registry with said first panel;

said second wall means having a length coextensive with said first wall means, an intermediate transverse hinge, and releasable attachment means for removably securing said second wall means with its transverse hinge overlying a corner of said first panel different from that overlain by said first wall means such that said first and second wall means extend along adjacent edges of said first panel to form a tray;

second fastening means operable upon release of said attachment means for said second wall means for coupling said second wall means to said second panel coextensive with and along an edge of said second panel corresponding to said one edge of said first panel; and said first wall means coupled to said first panel and said second wall means coupled to said second panel constituting binder ends between which said leaves of paper may be bound.

8. A package unit which is adapted for conversion to a binder, comprising:

a stack of leaves of paper;

a tray-shaped receptacle having a panel of sheet material with mutually perpendicular end and side edges, said panel having its length and width between said edges substantially coextensive with one of said leaves of paper;

wall means of like sheet material for laterally positioning the stack of paper in registry with said panel;

attachment means for removably attaching said wall means to said panel along its edges projecting out of the plane of the panel;

said wall means having means for binding said leaves of paper;

said wall means having a pair of transverse hinges, said releasable attachment means securing said wall means with its transverse hinges overlying adjacent corners of said panel such that said wall means extends along adjacent edges of said panel to form a tray;

wrapping means for overwrapping said stack within said receptacle; and fastening means operable upon release of said attachment means for coupling said wall means to the panel in a different position along an edge thereof to expose said binding means;

whereby a complete package of paper with tray and binder is provided.

9. A tray-shaped package for a stack of leaves of paper and the like which is adapted for conversion to a binder, comprising:

a bottom panel of sheet material having mutually perpendicular end and side edges, said bottom panel having its length and width substantially coextensive with a leaf of said paper;

a cover panel substantially coextensive with said bottom panel;

said bottom and cover panels constituting end panels between which the paper may be sandwiched;

wall means adapted to be removably attached to said bottom panel for laterally positioning the paper on said bottom panel;

said wall means being further adapted for conversion to first and second binder hinges upon detachment for relocation and reattachment along corresponding edges of said bottom and cover panels such that a binder bottom and binder cover are formed;

said wall means including first and second strips, each of said strips having longitudinal hinge means extending the length of said strip for folding said strip into first and second sectors, said first sector being formed for attachment by said fastening means to one of said bottom or cover panels, and said second sector being formed for binding leaves of paper, and medial transverse hinge means extending the width of said second sector for folding said strip such that mutually perpendicular walls are formed when said first attachment sector is fastened to said bottom panel in the tray form; and fastening means for removably attaching said wall means to said bottom panel in the tray form and for coupling said first and second binder hinges to said bottom and cover panels respectively in the binder form.

10. A tray-shaped package for a stack of leaves of paper and the like which is adapted for conversion to a binder, comprising:

a panel of sheet material with mutually perpendicular end and side edges, said panel having its length and width substantially coextensive with one of said leaves of paper;

wall means of sheet material for laterally and longitudinally positioning the paper in registry with said panel, said wall means including first and second walls disposed along adjacent edges of said panel;

attachment means for hingedly attaching said wall means to said panel along its edges so that said wall means may project out of the plane of the panel;

said wall means having means for forming a corner between the first and second walls when attached to said panel, said corner forming means has a transverse hinge connecting said first and second walls whereby said wall means may be unfolded, said attachment means securing said wall means with the corner overlying a corner of said panel such that said wall means extends along adjacent edges of said panel to form a tray;

said wall means having means for binding leaves of paper; and at least one of said walls being releasably attached to said panel whereby a binder is formed when one of said walls is released.

11. An article as recited in claim 10 further comprising fastening means operable upon release of both of said walls for coupling said wall means to the panel in a different position along one edge thereof to expose said binding means whereby a binder is formed for said leaves from said panel and said wall means.

* * * * *